US006919010B1

(12) United States Patent
Mayer

(10) Patent No.: US 6,919,010 B1
(45) Date of Patent: Jul. 19, 2005

(54) UNIFORM ELECTROPLATING OF THIN METAL SEEDED WAFERS USING ROTATIONALLY ASYMMETRIC VARIABLE ANODE CORRECTION

(75) Inventor: Steven T. Mayer, Lake Oswego, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 10/916,374

(22) Filed: Aug. 10, 2004

Related U.S. Application Data

(63) Continuation-in-part of application No. 10/154,082, filed on May 22, 2002, now Pat. No. 6,773,571.

(60) Provisional application No. 60/580,572, filed on Jun. 16, 2004, and provisional application No. 60/302,111, filed on Jun. 28, 2001.

(51) Int. Cl.[7] ..... C25D 5/04; C25D 17/12

(52) U.S. Cl. ..... 205/96; 205/97; 205/104; 205/291; 205/292; 204/199; 204/218; 204/230.2; 204/242; 204/280

(58) Field of Search ..... 205/96, 97, 104, 205/291, 292; 204/199, 218, 230.2, 242, 280

(56) References Cited

U.S. PATENT DOCUMENTS

| | | | |
|---|---|---|---|
| 3,652,442 | A | 3/1972 | Powers et al. |
| 3,706,651 | A | 12/1972 | Leland |
| 3,862,891 | A | 1/1975 | Smith |
| 4,033,833 | A | 7/1977 | Bestel et al. |
| 4,082,638 | A | 4/1978 | Jumer |
| 4,240,886 | A | 12/1980 | Hodges et al. |
| 4,272,335 | A | 6/1981 | Combs |
| 4,304,641 | A | 12/1981 | Grandia et al. |
| 4,469,564 | A | 9/1984 | Okinaka et al. |
| 4,604,177 | A | 8/1986 | Sivilotti |

(Continued)

FOREIGN PATENT DOCUMENTS

| | | |
|---|---|---|
| EP | 0037325 | 10/1981 |
| JP | 59-162298 | 9/1984 |
| JP | 09-53197 | 2/1997 |
| JP | 2001316887 | 11/2001 |
| WO | WO/9941434 | 8/1999 |

OTHER PUBLICATIONS

Fang et al., "Uniform Copper Electroplating on Resistive Substrates," Abs. 167, 205$^{th}$ Meeting, © 2004 The Electrochemical Society, Inc., 1 page.

Mayer et al., Electrochemical Treatment of Integrated Circuit Substrates Using Concentratic Anodes and Variable Field Shaping Elements, U.S. Appl. No. 10/116,077, filed Apr. 4, 2002, 84 pages.

*Primary Examiner*—Robert R. Koehler
(74) *Attorney, Agent, or Firm*—Beyer, Weaver & Thomas, LLP

(57) ABSTRACT

A substantially uniform layer of a metal is electroplated onto a work piece having a seed layer thereon. The current of a plating cell is provided from an azimuthally asymmetric anode, which is rotated with respect to the work piece (i.e., either or both of the work piece and the anode may be rotating). The azimuthal asymmetry provides a time-of-exposure correction to the current distribution reaching the work piece, whereby peripheral regions of the work piece see less current than central regions over the period of rotation. In some embodiments, the total current is distributed among a plurality of anodes in the plating cell in order to tailor the current distribution in the plating electrolyte over time. Focusing elements may be used to create "virtual anodes" in proximity to the plating surface of the work piece to further control the current distribution in the electrolyte during plating.

26 Claims, 7 Drawing Sheets

U.S. PATENT DOCUMENTS 4,604,178 A 8/1986 Fleegener et al.
4,605,482 A 8/1986 Shirgami et al.
4,696,729 A 9/1987 Santini
4,828,654 A 5/1989 Reed
4,906,346 A 3/1990 Hadersbeck et al.
4,931,149 A 6/1990 Stierman et al.
4,933,061 A 6/1990 Kulkarni et al.
5,039,381 A 8/1991 Mullarkey
5,096,550 A 3/1992 Mayer et al.
5,146,136 A 9/1992 Ogura et al.
5,156,730 A 10/1992 Bhatt et al.
5,162,079 A 11/1992 Brown
5,217,586 A 6/1993 Datta et al.
5,316,642 A 5/1994 Young, Jr. et al.
5,368,711 A 11/1994 Poris
5,391,285 A 2/1995 Lytle et al.
5,421,987 A 6/1995 Tzanavaras et al.
5,443,707 A 8/1995 Mori
5,472,592 A 12/1995 Lowery
5,476,578 A 12/1995 Forand
5,498,325 A 3/1996 Nishimura et al.
5,516,412 A 5/1996 Andricacos et al.
5,567,300 A 10/1996 Datta et al.
5,935,402 A 8/1999 Fanti
6,027,631 A 2/2000 Broadbent
6,132,587 A 10/2000 Jorne
6,193,860 B1 2/2001 Weling
6,391,166 B1 5/2002 Wang
6,395,152 B1 5/2002 Wang
6,402,923 B1 6/2002 Mayer et al.
6,497,801 B1 12/2002 Woodruff et al.
6,527,920 B1 3/2003 Mayer
6,773,571 B1 8/2004 Mayer et al.
2003/0029527 A1 2/2003 Yajima et al.
2003/0102210 A1 6/2003 Woodruff

UNIFORM ELECTROPLATING OF THIN METAL SEEDED WAFERS USING ROTATIONALLY ASYMMETRIC VARIABLE ANODE CORRECTION

This application claims priority under 5 USC 119(e) from U.S. Provisional Application No. 60/580,572, naming Steven T. Mayer as inventor, filed Jun. 16, 2004, and titled, "Method of Depositing a Diffusion Barrier For Copper Interconnect Applications," and this application is also continuation in part of U.S. patent application Ser. No. 10/154,082, filed May 22, 2002 (now U.S. Pat. No. 6,773,571, issued Aug. 10, 2004) naming Steven T. Mayer et al. as inventors, issued Aug. 10, 2004, and titled, "Method And Apparatus for Uniform Electroplating of Thin Metal Seeded Wafers Using Multiple Segmented Virtual Anode Sources," which, in turn, claims priority under 35 USC 119(e) from U.S. U.S. Provisional Application No. 60/302,111, naming Steve Mayer et al. as inventors, filed Jun. 28, 2001, and titled "Method and Apparatus for Uniform Electroplating of Thin Metal Seeded Wafers Using Multiple Segmented Virtual Anode Sources." Each of these patent documents is incorporated herein by reference for all purposes.

BACKGROUND

The present invention pertains to methods and apparatus for electroplating metal onto a work piece. More specifically, the invention pertains to methods and apparatus for controlling the electrical resistance and current flow characteristics in an electrolyte environment encountered by the work piece during electroplating.

The transition from aluminum to copper required a change in process "architecture" (to damascene and dual-damascene) as well as a whole new set of process technologies. One process step used in producing copper damascene circuits is the formation of a "seed-" or "strike-" layer, which is then used as a base layer onto which copper is electroplated "electrofill"). The seed layer carriers the electrical plating current from the edge region of the wafer (where electrical contact is make) to all trench and via structures located across the wafer surface. The seed film is typically a thin conductive copper layer. It is separated from the insulating silicon dioxide or other dielectric by a barrier layer. The seed layer deposition process should yield a layer which has good overall adhesion, excellent step coverage (more particularly, conformal/continuous amounts of metal deposited onto the side-walls of an embedded structure), and minimal closure or "necking" of the top of the embedded feature.

Market trends of increasingly smaller features and alternative seeding processes drive the need for a capability to plate with a high degree of uniformity on increasingly thinner seeded wafers. In the future, it is anticipated that this film will become increasingly thin and may simply be composed of a plate-able barrier film, such as ruthenium, or a bilayer of a very thin barrier and copper (deposited, for example, by an atomic layer deposition (ALD) or similar process). These films present the engineer with an extreme terminal effect situation. For example, when driving a 3 amp total current uniformly into a 30 ohm per square ruthenium seed layer (a likely value for a 30–50 Åfilm) the resultant center to edge voltage drop in the metal will be over 2 volts.

FIG. 1 is a schematic of an approximated equivalent electrical circuit for the problem. It is simplified to one dimension for clarity. The continuous resistance in the seed layer is represented by a set of finite (in this case four) parallel circuit elements. The in-film resistor elements $R_f$, represent the differential resistance from an outer radial point to a more central radial point on the wafer. The total current supplied at the edge, $I_t$ is distributed to the various surface elements, $I_1$, $I_2$, etc., scaled by the total path resistances with respect to all the other resistances. The circuits more centrally located have a larger total resistance because of the cumulative/additive resistance of the $R_f$ for those paths. Mathematically, the fractional current $F_i$ through any one of the surface element paths is $$F_i = \frac{I_i}{I_t} = \frac{Z_T}{Zi} = \frac{\dfrac{1}{(iR_f + R_{ct,i} + W_i + R_{el,i})}}{\displaystyle\sum_1^n \frac{1}{iR_f + R_{ct,i} + W_i + R_{el,i}}} \tag{1}$$

where the subscripts i refer to the $i^{th}$ parallel current path and T to the total circuit, I is current, Z is overall (path) resistance, $R_f$ is the resistance in the metal film between each element (constructed, for simplicity, to be the same between each adjacent element), $R_{ct}$ is the local charge transfer resistance, $Z_w$ is the local diffusion (or Warberg) impedance and $R_{el}$ is the electrolyte resistance. With this, $I_i$ is the current to through the $i^{th}$ surface element pathway, and $I_t$ is the total current to the wafer. The charge transfer resistance at each interfacial location is represented by a set of resistors $R_{ct}$ in parallel with the double layer capacitance $C_{dl}$, but for the steady state case does not effect the current distribution. The diffusion resistances, represented by the Warberg impedance (symbol $Z_w$) and the electrolyte resistance ($R_{el}$) are shown in a set of parallel circuit paths, all in series with the particular surface element circuit, give one of several parallel paths for the current to traverse to the anode. In practice, $R_{ct}$ and $Z_w$ are quite non-linear (depending on current, time, concentrations, etc.), but this fact does not diminish the utility of this model in comparing how the current art and this disclosure differ in accomplishing uniform current distribution. To achieve a substantially uniform current distribution, the fractional current should be the same, irrespective of the element position (i). When all terms other than the film resistance term, $R_f$, are relatively small, the current to the $i^{th}$ element is $$F = \frac{\dfrac{1}{i}}{\displaystyle\sum_n^i \frac{1}{i}} \tag{2}$$

Equation 2 has a strong i (location) dependence and results when no significant current distribution compensating effects are active. In the other extreme, when $R_{ct}$, $Z_w$, $R_{el}$ or the sum of these terms are greater than $R_f$, the fractional current approaches a uniform distribution (F=1/i).

Classical means of improving plating non-uniformity draw upon (1) increase $R_{ct}$ through the use of charge transfer inhibitors (e.g., plating suppressors and levelers, with the goal of creating a big normal-to-the-surface voltage drop, making $R_f$ small with respect to $R_{ct}$) or (2) very high ionic electrolyte resistances (yielding a similar effect though $R_{el}$) or (3) creating a significant diffusion resistance ($Z_w$).

These approaches have significant limitations related to the physical properties of the materials and the processes. Typical surface polarization derived by organic additives cannot create polarization in excess of about 0.5V (which is a relatively small value in comparison to seed layer voltage drop that must be compensated). Also, because the conductivity of a plating bath is tied to its ionic concentration and pH, decreasing the conductivity directly and negatively impacts the rate of plating and morphology of the plated material.

Beyond the classical approaches, at least three other approaches have been pursued in the area of terminal effect compensation. The first class increases the electrolyte resistance (or effective resistance by interposing the a membrane in the electrolyte between the anode and cathode). The second class alters the effective ionic path resistance $R_{el}$ for different current path elements (i.e., it provides a non-uniform $R_{el}$ in the radial direction) in order to balance the resistance in the film with that external to the film. Some current shielding and concentric multiple anode source approaches fall into this solution class. Asymmetrical shielding elements have been examined as a way to change (tailor) the composite plating process uniformity. The change in plating current was estimated as the time averaged exposure that a rotating wafer would "see" with a mask of a certain shape and size covering the part during a rotational period. A third class utilizes a time averaging exposure effect (for example, with a rotating wafer and a current shield element) to, over time, plate the same thickness at all locations. See U.S. Pat. No. 6,027,631 issued to Broadbent et al. on Feb. 22, 2000, which is incorporated herein by reference for all purposes.

While the approaches discussed above have proven useful, they suffer a number of potential limitations such as (1) the inability to continuously (throughout the process) change the resistance compensation as appropriate when the thickness of the plated layer grows and thereby reduces the electronic resistance, (2) a high cost of implementation, and/or (3) mechanical limitations (e.g., excess number of moving parts in a corrosive bath, material compatibility limitations, or reliability). Furthermore, the above approaches are not all easily adaptable/integrateable to particularly desirable apparatus configurations such as micro-cell configurations, a newly developed and desirable class of plating cells. See U.S. Patent Publication No. 2004/0065540 (Mayer et al.), titled "Liquid Treatment Using Thin Liquid Layer," and published Apr. 8, 2004, which is incorporated herein by reference for all purposes.

What is needed therefore is an improved technique for uniform electroplating onto thin-metal seeded wafers, particularly wafers with large diameters (e.g. 300 mm).

SUMMARY

The present invention pertains to methods and apparatus for electroplating a substantially uniform layer of a metal onto a work piece having a seed layer thereon. The ionic current of a plating cell is provided by an azimuthally asymmetric anode that is aligned with the work piece. The anode is shaped so that when the work piece is rotated with respect to the anode the current source, the ionic current (as delivered from the anode) is non-uniformly distributed in the radial direction and is concentrated toward the center of the work piece (when averaged over the period of rotation). Thus, the current is tailored to compensate for resistance and voltage variation across a work piece due to the thin seed layer. Insulating walls (sometimes called focusing elements) around the edge of the asymmetric anode and extending toward the work piece may be employed to create a "virtual anode" in proximity to the plating surface of the work piece to further control the current distribution in the electrolyte during plating.

As the thickness of the plated layer increases, the electronic current equalizes in the radial direction, and it becomes less necessary that the anode provide radially non-uniform ionic current. To address this some embodiments of the invention provide one or more other anode segments, in addition to the azimuthally asymmetric anode described above. These are isolated from one another and from the asymmetric anode so that they can serve as separate current sources to be turned on at different times as plating progresses and used to gradually equalize the radial current distribution provided by the anode sources. To protect against an abrupt change in current distribution, the additional anode segments can be turned on gradually by gradually increasing the level of current provided from them. Alternatively, they can be turned on gradually by initially pulsing the delivered current with a relatively small duty cycle. The duty cycle can then be increased gradually to gradually equalize the current distribution in the radial direction. Other mechanisms can be employed to control the relative amounts of current provided by the main asymmetric anode and the one or more other anode segments.

One aspect of the invention is a method for electroplating a substantially uniform layer of a metal onto a work piece having a seed layer thereon. Such methods may be characterized by the following operations: (a) providing an azimuthally asymmetric anode in a reactor; (b) providing the work piece in the reactor at a position substantially aligned with the azimuthally asymmetric anode; (c) rotating the work piece with respect to the azimuthally asymmetric anode while contacting a plating solution containing ions of the metal; and (d) plating metal onto the work piece while rotating to thereby provide a radially varying source of current over the period of rotation.

Typically, operation (d) involves immersing at least that portion of the work piece having the seed layer in the plating solution. Then, current is passed between the seed layer and the azimuthally asymmetric anode and the current is distributed such that, over a period of rotation, the metal is deposited substantially uniformly onto the entire surface area of the seed layer. This is because rotating the work piece with respect to the azimuthally asymmetric anode effectively increases the current at or near the center of rotation in relation to the current at the anode periphery.

In some embodiments, the method additionally provides one or more anode segments, each electrically isolated from each other and from the azimuthally asymmetric anode so that the anode and all anode segments can deliver plating current independently of one another. This allows the azimuthal distribution of current provided by the anode to change over time as the deposited layer grows thicker and the terminal effect diminishes. To this end, the method delivers current from an anode segment only after the plating from the asymmetric anode has taken place for a period of time (during which the terminal effect diminishes). To gradually increase the effect of an anode segment, the current from that segment can be initially delivered in pulses and the duty cycle of those pulses can increase over time such that a percentage of the total current attributable to the anode segment increases over time.

Another aspect of the invention is an apparatus for electroplating a substantially uniform layer of a metal onto a wafer. Such apparatus may be characterized by the following features: (a) a reactor chamber; (b) an azimuthally asymmetric anode in the reactor chamber; (c) a work piece holder for holding the work piece in the reactor at a position substantially in alignment with the azimuthally asymmetric anode; and (d) a mechanism for rotating at least one of the work piece and the azimuthally asymmetric anode with respect to the other.

As indicated in the method aspect described above, the apparatus may include one or more anode segments, each isolated from each other and from the azimuthally asymmetric anode so that they can deliver plating current independently of one another. To facilitate use of these separate anode sources, the apparatus may include a control circuit for independently adjusting the current delivered from the azimuthally asymmetric anode and each of the one or more anode segments. That control circuit can be designed or configured to deliver current from an anode segment only after first delivering current from the azimuthally asymmetric anode for a period of time. It can also be designed or configured to deliver current pulses from the anode segment, and possibly adjust a duty cycle of the current pulses over time such that a percentage of the total current attributable to the anode segment increases over time.

In some embodiments, the apparatus also includes an insulating focusing wall around the azimuthally asymmetric anode to focus current from the asymmetric anode during electroplating. When additional anode segments are employed, the apparatus may include additional insulating focusing walls around the anode segments to focus current from the anode segment in the electrolyte.

These and other features and advantages of the present invention will be described in more detail below with reference to the associated drawings.

DETAILED DESCRIPTION

Introduction

Figure 1:
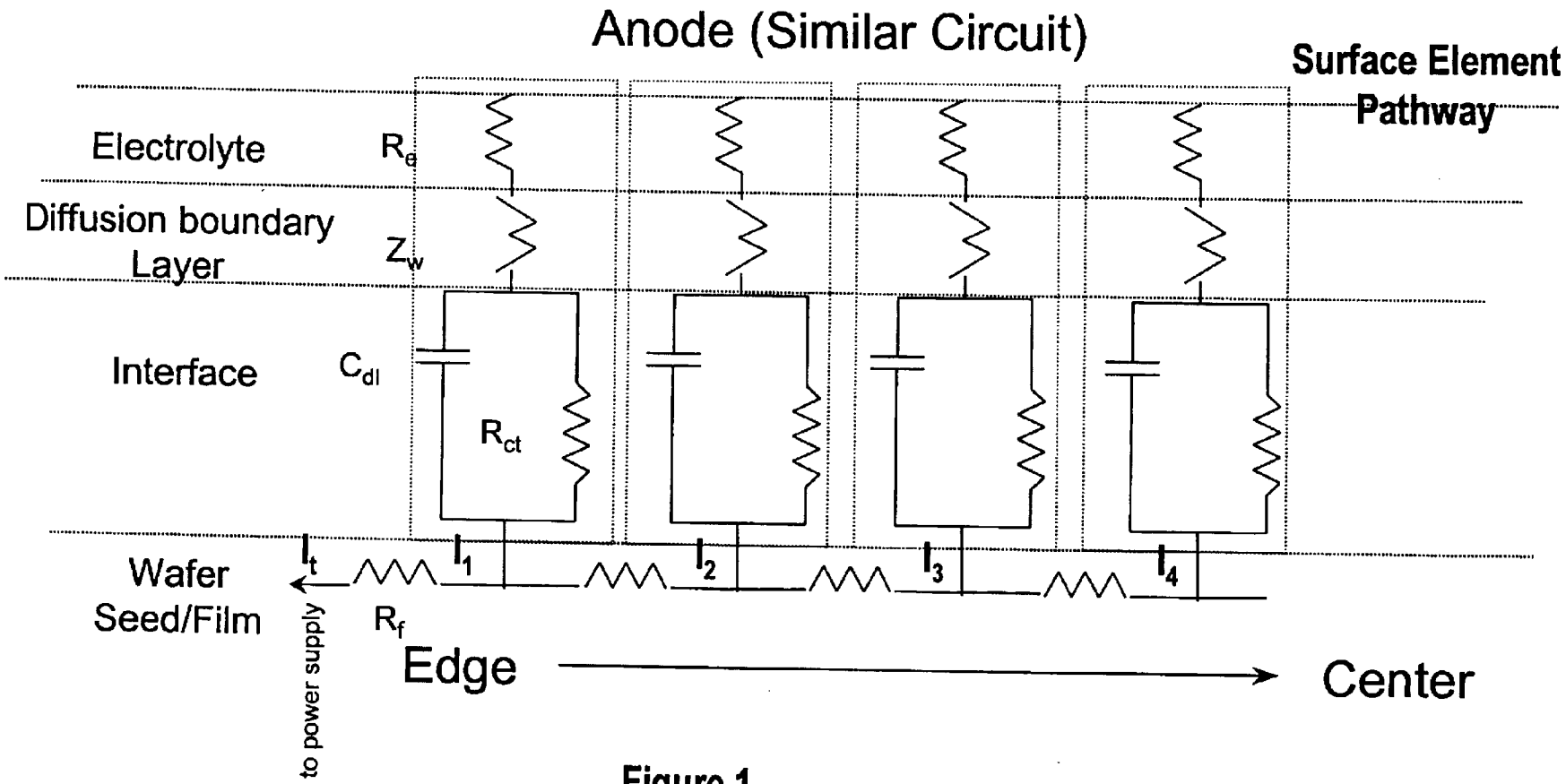
FIG. 1 is a schematic diagram depicting an equivalent circuit for electroplating on a thin seed layer.

In the following detailed description of the present invention, specific embodiments are set forth. However, as will be apparent to those skilled in the art, the present invention may be practiced without these specific details or by using alternate elements or processes. For example, the invention is described in terms of electroplating on wafers, particularly semiconductor wafers undergoing damascene processing. However, the work piece is not limited to such wafers. The work piece may be of various shapes, sizes, and materials. In addition to semiconductor wafers, other work pieces that may take advantage of this invention include various articles such as printed circuit boards, flat panel displays, and the like.

As mentioned, the invention pertains to methods and apparatus for electroplating a substantially uniform layer of a metal onto a work piece having a seed layer thereon. The ionic current of a plating cell is provided using an azimuthally asymmetric anode where the anode and the work piece are aligned and at least one of them rotates in order to tailor the current distribution in the plating electrolyte to compensate for resistance and voltage variation across a work piece due to the seed layer. Stated another way, the asymmetric virtual anode sources of this invention correct for radial plating-rate non-uniformities by exposing a rotating substrate (wafer) to an anode or virtual anode whose shape yields less anode exposure at larger radii over a given rotation, and compensates for the natural higher plating rate while the wafer is exposed to the anode. As the film grows and the resistance gets smaller, radial current density differences decrease, requiring a longer exposure to an anode/virtual-anode at larger radii than earlier in the process. Additional asymmetric electrodes are then added to the overall anode circuit (by individually energizing them), thereby increasing the anode exposure time as the process proceeds. In some embodiments, vertical insulating walls around the individual anodes serve as focusing elements to create "virtual anodes" in proximity to the plating surface of the work piece to further control the current distribution in the electrolyte during plating.

This invention is described in relation to electroplating methods and apparatus for use in integrated circuit (IC) fabrication. In this respect, the invention provides a simple, low cost, reliable method for the production of uniform electroplated films on very thin metal seeded wafers for integrated circuit fabrication, yielding improvements over the capabilities of current technology. This invention provides excellent uniformity control and improved electrofilling quality of wafers having thinner-seed layers; larger diameters (e.g., 300 mm), higher feature densities, and smaller feature sizes.

The invention relates to particular plating tools and processes in which electrical contact is made in the edge region of the wafer substrate. The invention is not limited to any general type of apparatus. One suitable example is the SABRE™ clamshell electroplating apparatus available from Novellus Systems, Inc. of San Jose, Calif. and described in U.S. Pat. Nos. 6,156,167, 6,159,354, 6,193,859, and 6,139,712, and in U.S. patent application Ser. No. 10/010,954, filed Nov. 30, 2001, titled "Improved Clamshell Apparatus with Dynamic Uniformity Control," which is herein incorporated by reference in its entirety. Another example is a microcell configuration as described in U.S. Patent Publication No. 2004/0065540 (Mayer et al.), which was previously incorporated by reference.

Various terms of art are used in this description of this invention. These terms should be construed broadly. Some relevant considerations follow.

Wafer—Frequently, a semiconductor wafer is the work piece to be plated. The invention is not so limited. In this document, the term "wafer" will be used interchangeably with "wafer substrate", and "substrate." One skilled in the art would understand that these terms could refer to a semiconductor (e.g. silicon) wafer during any of many stages of integrated circuit fabrication thereon.

Wafer Holder—A wafer holder generally describes a component that immobilizes a wafer and has positioning components for moving the wafer, e.g. rotation, immersion, and that has circuitry for applying an electrical potential to the wafer via a conductive layer thereon. An exemplary wafer holder is the Clamshell apparatus available from Novellus Systems, Inc. of San Jose, Calif. A detailed description of the clamshell wafer holder is provided in U.S.

Pat. Nos. 6,156,167, 6,159,354, 6,193,859, and 6,139,712, each of which is incorporated herein by reference for all purposes. In a microcell reactor, a mechanical or vacuum chuck may be employed to hold the wafer. This is described in the above-referenced U.S. Patent Publication No. 2004/0065540.

Seed Layer—A seed layer generally refers to a thin conductive layer on a work piece through which current is passed to effect, for example, electroplating. Frequently, seed layers of the invention will be copper layers on wafers, however, the invention is not so limited. Layers of other materials such as ruthenium and some conductive barrier materials may be employed as well. The seed layer thickness is generally a function of the technology node being implemented. In many situations, the seed layer will have a thickness of between about 30 and 1000 Angstroms.

Focusing Element—A focusing element is a structure that focuses, contains, segregates, channels, or otherwise directs the current density in an electrolyte arising from a particular anodes interaction with a cathode. For example, focusing walls refers to a insulating walls that focus, contain, segregate, channel, or otherwise directs the current density in a region of an electrolyte within the element between an anode, contained within the element, and the cathode (e.g. a seed layer on a work piece). If a plurality of closed focusing walls are used in conjunction with distinct anode structures, then each closed wall focuses, contains, segregates, and otherwise directs the current density in a region of the electrolyte within it and between an anode, also contained within it, and the cathode.

Virtual Anode—A virtual anode refers to the aperture of a focusing element, e.g. a closed focusing wall, through which current from an actual anode passes before reaching a cathode. For a closed focusing wall, the virtual anode work surface area is defined by the inner walls of the topmost portion (an open end) of such wall through which current passes before reaching the cathode. If an asymmetric anode is a corresponding asymmetrically shaped focusing element, then its corresponding virtual anode has a similar asymmetric-shaped structure. In this application the area spanned by the virtual anode is termed the "work surface area" of the virtual anode. When a focusing element is used with an anode, the plating current in the electrolyte induced between the anode and a cathode of a plating cell must pass through the work surface area (i.e. an aperture) of the corresponding virtual anode produced by the focusing element. Generally, virtual anodes of the invention are of fixed area, that is, the focusing element apertures are not dynamically controlled (e.g. an iris). However, such apparatus are not outside of the scope of the invention. A detailed description of focusing elements used in conjunction with shielding elements is described in U.S. Pat. No. 6,755,954, having Steven T. Mayer et al. as inventors, issued Jun. 29, 2004, and titled "Electrochemical Treatment of Integrated Circuit Substrates Using Concentric Anodes and Variable Field Shaping Elements," which is incorporated herein by reference for all purposes.

Time of exposure correction to the current distribution—This refers to a current distribution correction technique in which regions of the work piece near the terminal are directly exposed to current from an anode source for less time than are regions far removed from the terminal. In the typical wafer-plating scenario described above, the terminal is located at the perimeter of wafer. In such scenario, the time of exposure correction is applied so that the edge regions of the wafer are directly exposed to the anode current for only a fraction of the time that the central regions of the wafer are so exposed. The time of plating can be controlled in various ways. In this invention, it is accomplished by periodically aligning different regions of the work piece over, one or more anodes during plating his may be conveniently by rotating the wafer above an asymmetric anode as described herein.

AZIMUTHALLY ASYMMETRIC ANODE AND ASSEMBLY OF ANODES

Figure 2:
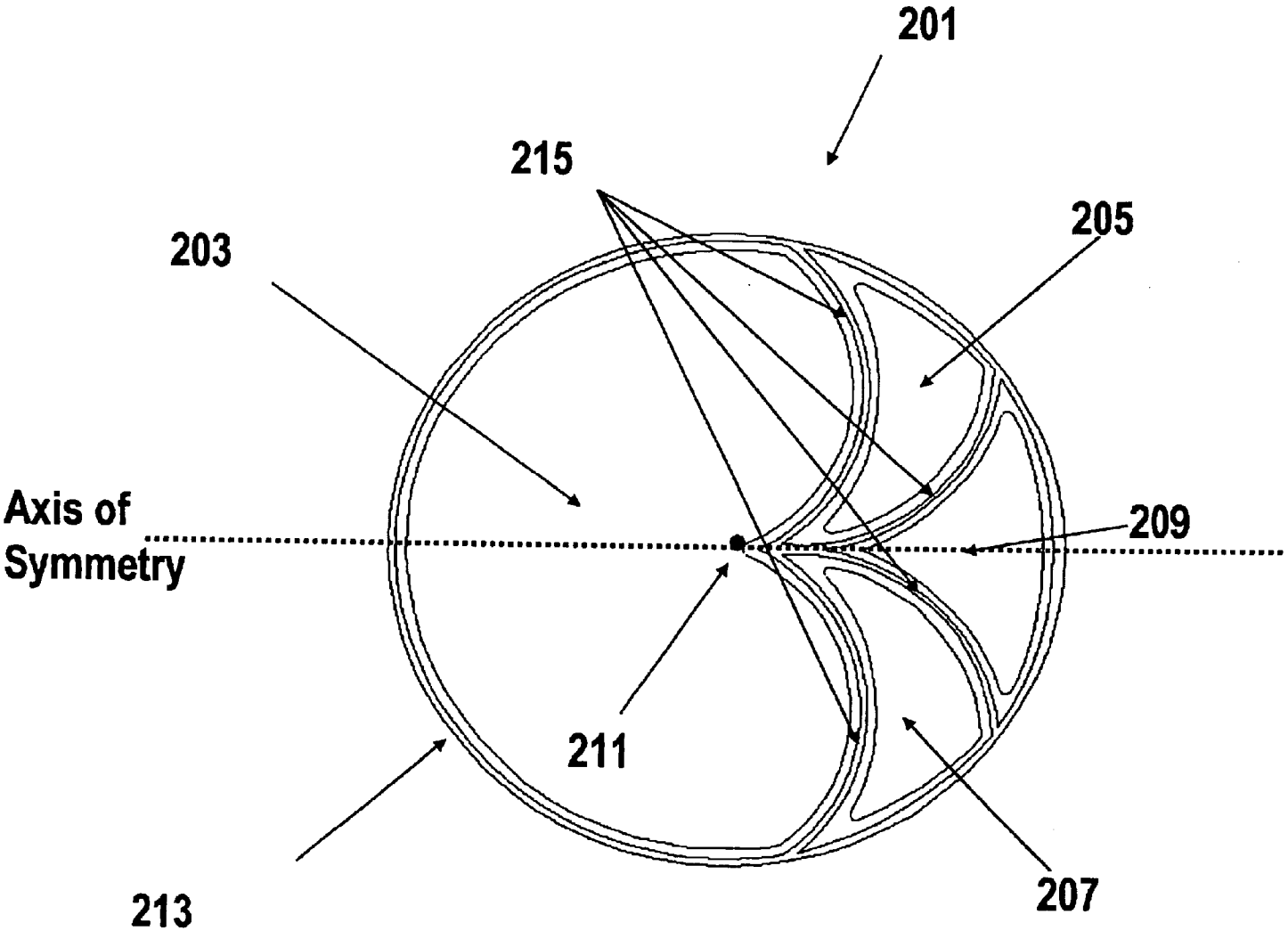
FIG. 2 is a top down schematic of an asymmetric anoide design in accordance with an embodiment of this invention.

A top down schematic of an exemplary asymmetric anode design is shown in FIG. 2. In this design, an anode, assembly 201 includes a primary azimuthally asymmetric anode 203 and multiple secondary anode segments 205, 207, and 209. The work piece which is not shown, lies above anode assembly 201 and rotates about an axis substantially aligned with a center axis 211 of the anode assembly. In a typical embodiment, the footprint of the work piece corresponds (at least roughly) to the perimeter of anode assembly 201.

Initally, to provide a large fraction ionic current to the central region of the work piece (proximate the rotational axis), only asymmetric anode 203 is energized and provide current. The region of assembly 201 occupied by segments 205, 207, and 209 do not provide any significant current during this initial phase of the plating process when the terminal effect is most severe. Thus, at any given instant in time, a relatively large section of the work piece periphery is not located over top of anode 203 (or otherwise aligned with any portion of anode 203). Of course, as the work piece rotates, any given point on its periphery comes over the region of anode 203 and then passes beyond it. Because a relatively large segment of the-work-piece periphery is out of "contact" with anode 203 at any instant in time, while much more of the central regions remains in contact, the driving force for plating from anode 203 is non-uniformly distributed over the radius of the work piece. This compensates for the terminal effect described above. As the plated layer grows, and the terminal effect decreases, the other anode segments can be turned on gradually.

The asymmetric anode is shaped to yield a particular time-of-exposure correction to the current distribution. As shown in the example of FIG. 2, a portion of anode 203 is generally circular, having a constant radius from center point 211. This is the left side of the anode as shown in FIG. 2. In the depicted example, the region of constant radius occupies nearly 180 degrees of the overall anode assembly. Beyond this region, the radius gradually decreases toward an angular position where the radius becomes zero. That is, there are no abrupt changes in radial value as one moves azimuthally. In the example at hand, this produces the heart shaped structure shown in FIG. 2. With this design, the outer radius of the work piece will lie over top of the anode during only one-half the period of rotation. More centrally located regions of the work piece will lie over top of the anode for progressively longer periods of time.

Many possible shapes will provide the benefits of this invention. Generally, the anode will be azimuthally asymmetric. In other words, the anode varies in some manner at different azimuthal positions. This is manifest as a structure having different amounts of anode material at different azimuthal positions. Typically, the anode radius varies azimuthally, with some azimuthal fraction of the anode having a constant or nearly constant radius. Over the remaining azimuthal fraction the radius varies, typically in a gradual manner. Of course, many other azimuthally asymmetric shapes can be employed. For example one azimuthal portion of the anode can have a radius co-extensive with that of the work piece and another azimuthal portion can have a smaller radius. An abruptly or gradually varying radius can separate the two azimuthal portions. Other shapes will be readily apparent to those of skill in the art. Generally, the angular arc occupied by the anode will be greater in the more central regions (determined with reference to the aligned work piece) than the terminal edge regions. By controlling the anode shape, one can easily attain a ratio of 2 or more in current directed at the center of the work piece with respect to current directed at the periphery of the work piece.

One way to estimate a useful asymmetric shape is to first determine (via mathematical simulation or experimentation) the current distribution I(r) that would result from plating a substrate in the same plating bath and all other tool design consideration at the same target nominal plating rate and an anode of a complete disk shape (i.e., no partitioning). A time-of exposure correction function F(r) is obtained as the ratio of the current at the wafer center I(0) to the current at the particular radius I(r).

$$F(r) = \frac{I(0)}{I(r)} \tag{3}$$

The radial coordinate angle of the anode edge/insulator wall is then readily determined as follows.

$$\Theta = 2\pi(1 - F((r)) \tag{4}$$

Figure 3:
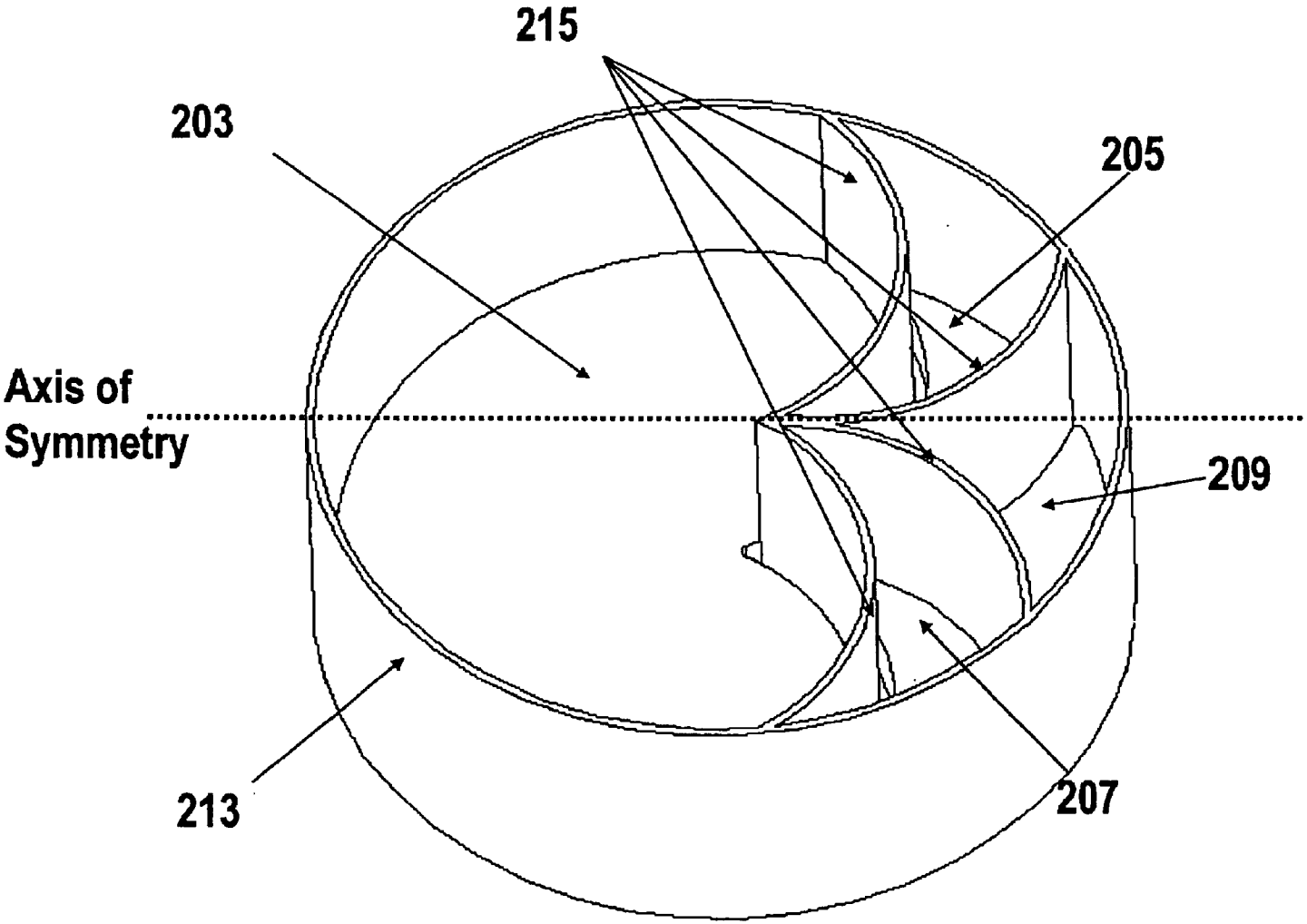
FIG. 3 is a diagram of the anode design of FIG. 2 and having vertically extending focusing elements to create virtual anodes in accordance with an embodiment of this invention.

As shown in FIG. 2, the anode assembly is contained within a vertically extending anode chamber wall 213. In addition, the individual anode segments (including asymmetric anode 203) are isolated from one another by vertically extending anode isolator walls 215. FIG. 3 shows this structure more clearly in perspective view. This structure serves to produce closed isolator walls around the individual anode segments of assembly 201. Each anode segment may be electrically isolated from one another and the ionic current produced there from is confined within the closed isolator wall until reaching the top of the wall. This allows the actual anode to be significantly removed from the substrate, creating a "virtual anode" (which is much closer to the substrate) and isolating the individual anodes and limiting their interactions.

The creation of a virtual anode, as used herein, is significant. The combination of the anode lying within and at the base of it individual asymmetric anode chambers (as defined by the anode chamber outer wall 213 and the individual interior asymmetric anode walls 215) creates a "virtual" asymmetric anode. Such an anode construct is mathematically similar to the situation of having an anode of the same shape at the opening of the asymmetric anode chamber. Therefore, one can obtain the benefits of having an anode at that location while having the anode physically located at other locations.

As indicated, initially in the plating process the terminal effect is most severe. At this stage, it is desirable to have all current provided by the principal asymmetric anode 203. But later in the process, as the terminal effect dissipates, the center plating rate will tend to increase. Allowed to continue unabated, this would lead to a non-uniform film in which the center is over-plated. To compensate for this effect, the invention may use multiple asymmetric anodes (such as those shown in FIGS. 2 and 3), each acting as a separate (in some cases virtual) anode source. At the appropriate time(s), additional asymmetric anodes are made "active" by connecting them to the anode lead of the power supply (for example, via a relay). These added electrodes increase the average time-of-exposure of edge substrate regions versus their earlier, more restricted exposure, thereby increasing the time-integrated average current at the edge and compensating for this effect. As shown in the FIGS. 2 and 3, the added anodes may have a generally triangular shape with curved edges. Of course, many other shapes can be employed.

Figure 4:
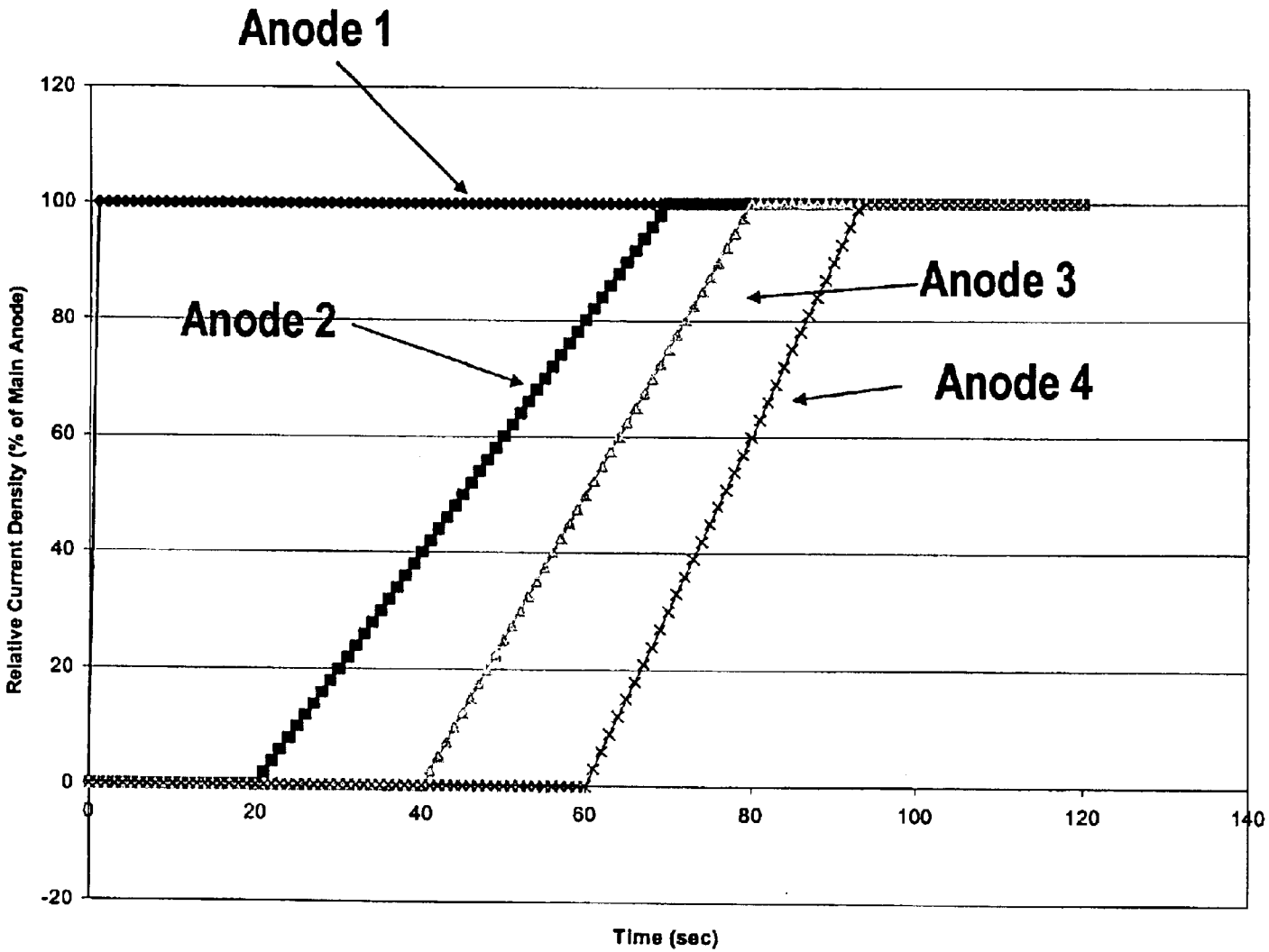
FIG. 4 is a graph showing the current level versus time sequence provided by individual is asymmetric anodes in an a anode assembly according an embodiment of this

A significant degree of process flexibility and control can be achieved by using a lower current or a periodic or pulsing activation of the secondary asymmetric electrodes, as the need for more edge current at the edge region is required (specifically as the film thickness and the process progresses). This is depicted graphically in FIG. 4. As an example, rather than having one or more of the secondary asymmetric electrodes be energized at the same current as the first anode (primary anode 1 shown in FIG. 4), the current can be gradually increased in time, thereby slowly transitioning from a state or no current over a finite arc length of rotation, to a smaller and smaller difference over the total rotation. As shown in FIG. 4, the current anode 2 gradually ramps up to full value (the same magnitude as anode 1) over a period of approximately 40 seconds. Then later in the plating process, anode 3 is gradually activated over a period of approximately 0 seconds. Finally the last anode, anode 4, is gradually activated again over a period of approximately 30 seconds. Successive and gradual activation in this manner provides a finely controlled change in the current distribution, moving toward a more uniform distribution.

Figure 5:
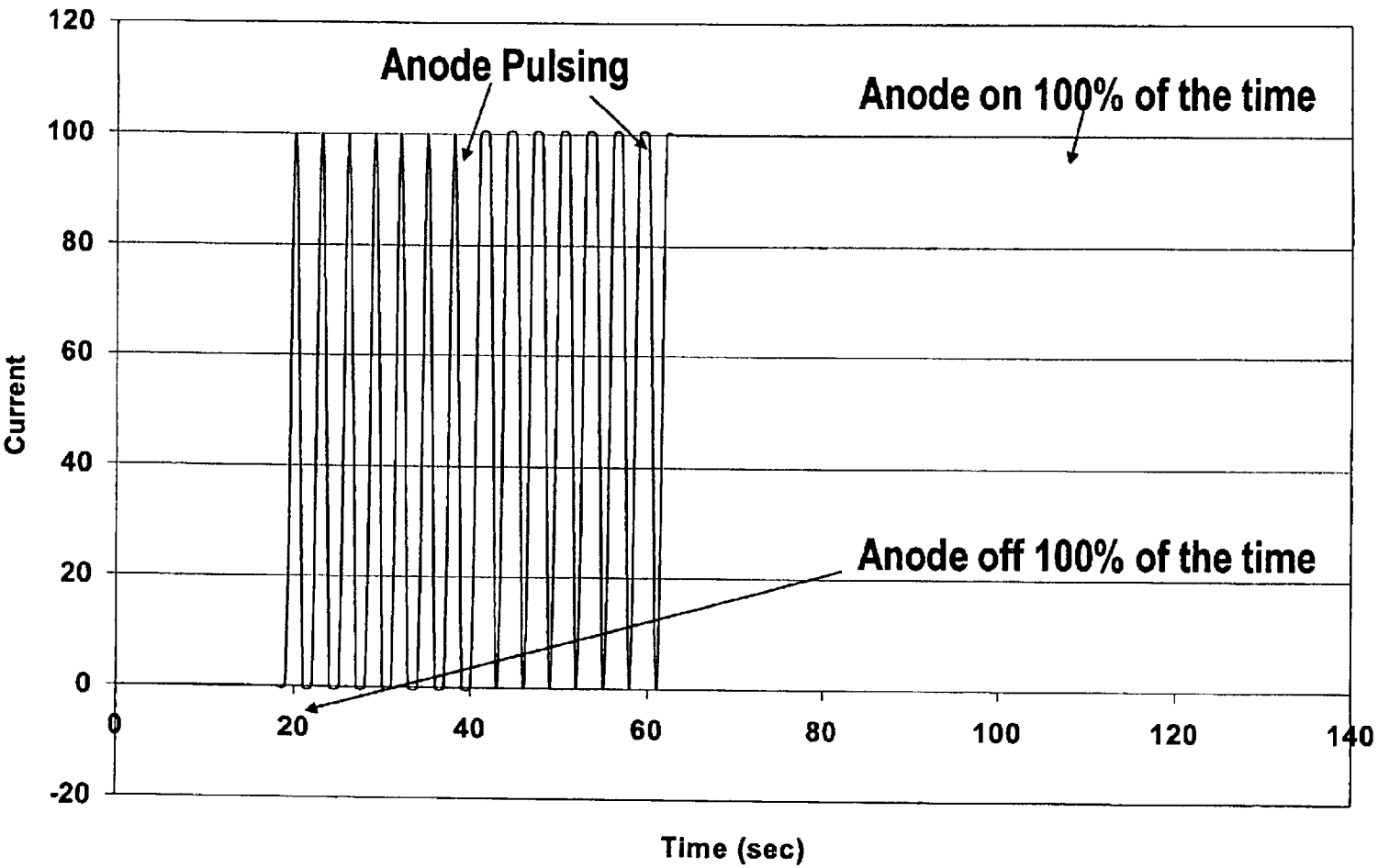
FIG. 5 is a graph showing an exemnplary pulsing procedure in which a secondary asymmetric anode gradually comes up to 100% activation.

In another example, rather than having one or more secondary asymmetric anodes become energized 100% of the time when activated, they can be energized for only a fraction of the total time. In other words, the anodes can pulsed so that they provide current for only a fraction of the time. The amplitude of the current pulses can be full height (e.g., at the level of the current delivered by the primary asymmetric anode) or limited to some fraction of the full height. In one embodiment, the duty cycle of the current pulsing can be increased over time to provide a gradual increase in the contribution of the secondary anode(s) to the total current delivered. A simple approach to varying the duty cycle is shown in FIG. 5.

In the case of pulsing, two methods of pulsing may be considered. One uses a relatively high pulsing rate with respect to the period of wafer rotation. The other uses a slower pulsing rate in which on-off periods are cycled to coincide with the rotation period and modulate an integral number of rotation cycles that the current is on and is off. Gradually, the ratio of the number of on cycles with respect to the number of off cycles can be increased until that particular anode is finally on 100% of the time. Other anode segments (for example, anodes, 207 and 209 in FIGS. 2 and 3) can be sequenced to follow a similar process trend, only later in the overall process. This allows for a gradual transition between the fully off and fully on states for any given asymmetric anode. Note that if one desires to maintain azimuthal uniformity of the process using relatively long pulsing time (0.25 sec to 10 seconds, corresponding to a wafer rotation rate of from 240 down to 6 rpm), the on-to-off times generally should be an integral value, with the fundamental base period equal to an integral of the rotation period. FIG. 5 shows an example of duty cycles and currents for one of these schemes.

In certain circumstances (particularly with very thin seed layer films) the initial plated relative edge-to-center current can be quite large and may not be adequately compensated for using the asymmetric anode method alone. For example, when plating a wafer and filling recessed features for damascene circuit manufacturing, there is a limited current density range (a current density "operating window") over which successful void-free feature filling and defect free plating will be obtained. If the intrinsic non-uniformity without using an asymmetric anode is too great, the asymmetric anode may be combined with other techniques (e.g., variable shielding, concentric anodes, or a membrane located close to the wafer) to bring the non-uniformity within an asymmetric anode correctable range.

Method

Figure 6:
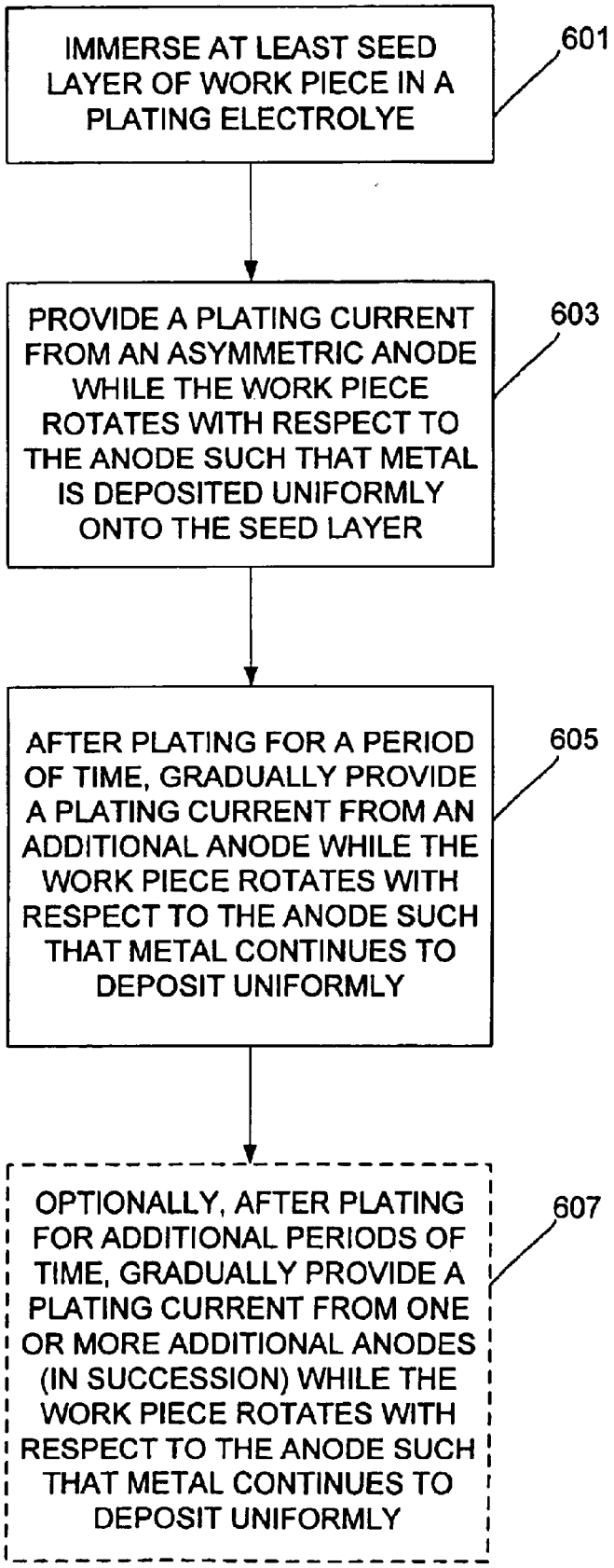
FIG. 6 is a flowchart depicting aspects of a method in accordance with the invention.

FIG. 6 shows an exemplary method, 600, for electroplating a substantially uniform layer of a metal onto a work piece having a seed layer thereon. Initially, at least that portion of the work piece having the seed layer thereon is contacted with an electrolyte containing ions of the metal. See 601. The electrolyte is provided in a plating cell containing an asymmetric anode assembly of this invention. Upon entry of the seed layer into the plating solution, or shortly thereafter, a plating current is provided from the primary asymmetric anode (e.g., anode 203 in FIGS. 2 and 3). See 603. The work piece and/or the asymmetric anode are rotated such that the peripheral regions of the work piece are directly aligned with the anode for only limited times during each rotation. In this manner, current from the anode is distributed non-uniformly over the seed layer radius providing a time of exposure correction.

After plating has occurred for a period of time, the resistance of the metal layer on the work piece decreases and the terminal effect begins to diminish. To address this situation, the current from anode assembly is modified by gradually providing a plating current from a secondary asymmetric anode in the plating solution (e.g., anode 205 in FIGS. 2 and 3). See 605. The work piece continues to rotate during this phase of the process. The current from the secondary anode may gradually increased as depicted in FIG. 4 and/or pulsed with a varying duty cycle so that the contribution of the secondary electrode to the total current increases in a controlled manner.

After the current from the secondary electrode has been increased to its maximum point, it is possible that the current distribution from the anode assembly is sufficiently uniform to allow plating to continue to conclusion with the desired result (a radially uniform deposit of metal). This may result when, for example, there are only two anode segments in the anode assembly—a primary asymmetric anode and one secondary asymmetric anode that occupies all or most of the circular region not occupied by the primary anode. Even without an anode arrangement of this form, the degree of uniformity in current distribution may be sufficient for the plating in some applications.

Alternatively, it will be necessary to further increase the uniformity of the current from the anode assembly at some time after the secondary anode is energized at 605. To this end, an optional operation (or operations) is provided at 607. This involves energizing one or more additional anodes (typically in succession) from the anode assembly. This is accomplished while the work piece continues to rotate with respect to the anode assembly. Typically, the additional anodes energize gradually as described above, again to finely control the change in current distribution from the anode assembly.

Throughout the process, the metal is preferably continuously deposited onto the surface area of the seed layer exposed to the electrolyte during plating. After a uniform metal layer of desired thickness is plated onto the work piece, the method of FIG. 6 is completed. As mentioned, semiconductor wafers are exemplary work pieces for methods of the invention.

As illustrated, this invention provides flexibility to address changing or special current distribution requirements. Initially, compensating for the terminal effect when the seed layer is thin, the current is distributed disproportionately so that an inner area of the wafer receives a far larger fraction of the current in the electrolyte resulting from the potential applied to an anode (or anodes) proximate to the inner region. As the plated layer thickens and the terminal effect lessens, the plating current is distributed between the multiple anodes to produce a more uniform distribution suitable for a current state of plating. In this way, the current density in the electrolyte is tailored to provide uniform plating onto the seed layer despite changes during plating and/or resistance irregularities encountered in the seed layer. If focusing elements are used, then the plating current is distributed between the anodes toward a distribution that corresponds substantially to the work surface areas of the virtual anodes. For example, the actual anodes of the invention may be irregular or have large surface areas (such as a porous anode) but focusing elements of the invention provide a way to create uniform virtual anodes from any shape actual anode.

Plating cell

The disclosed equipment and methods are not limited in use to a particular electroplating tool design or plating chemistry. The functional operation of the design is to compensate for preferred edge plating associated with electrical resistance and voltage drop across the wafer (particularly at the beginning of the plating process when the seed layer is most resistive) by limiting and modifying the amount of anode exposure during the substrates rotation.

Figure 7:
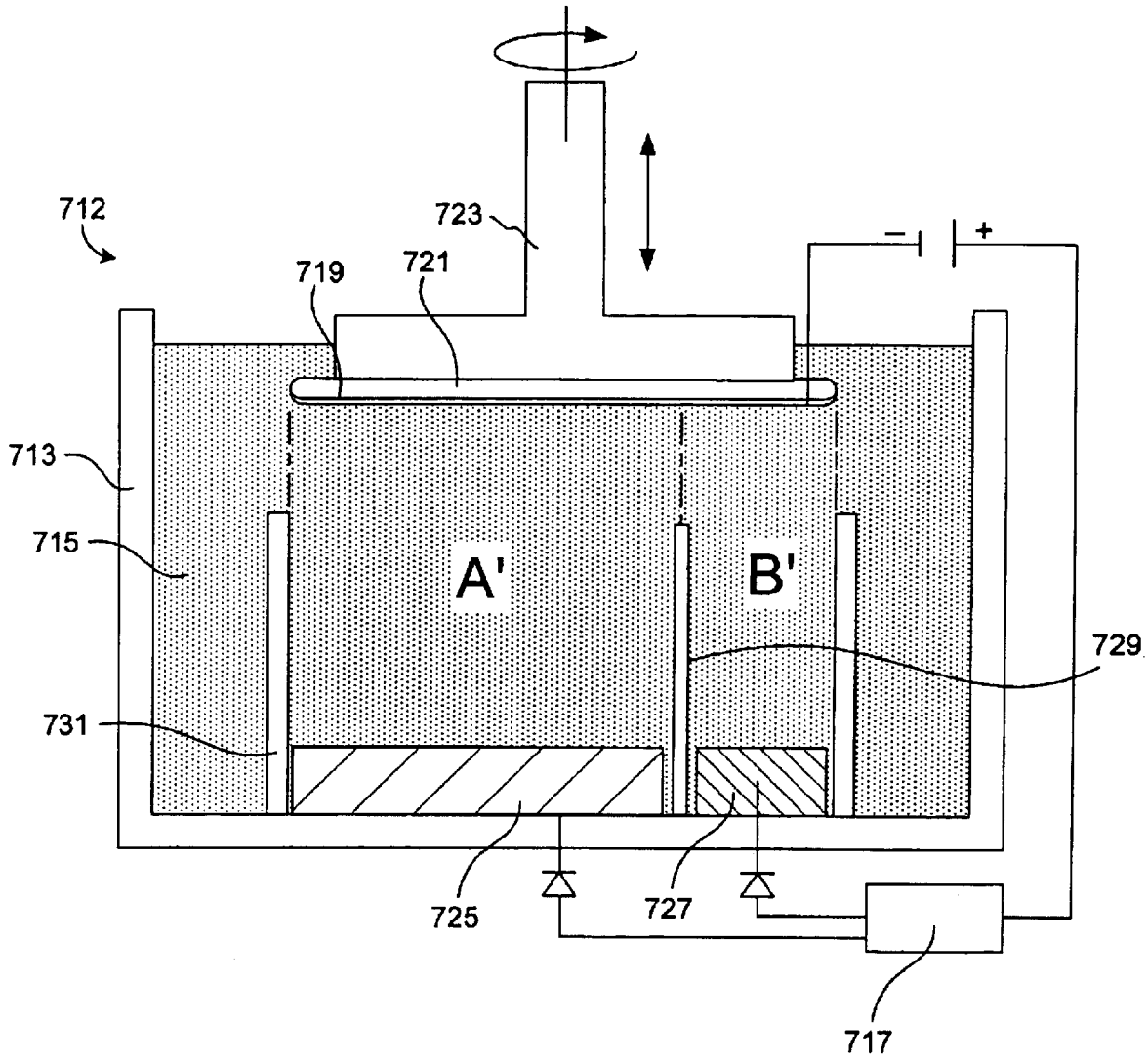
FIG. 7 is a cross section depicting a plating cell suitable for this invention.

FIG. 7 is a simplified cross-section of a plating cell, 712, of the invention. Plating cell 712 has a vessel 713, for holding electrolyte 715 (preferably containing copper ions for plating copper onto a seed layer). A wafer holder 723 holds a wafer 721, which has a seed layer 719 thereon. In a typical damascene process, seed layer 719 is a copper seed layer. A circuit 717 distributes the plating current variably to each of two anodes, a primary asymmetric anode 725 and a secondary asymmetric anode 727. In one example, such a circuit employs diodes to ensure unidirectional current flow and lessen cross communication in the cell with respect to the anodes. In one embodiment, the work surface of the primary asymmetric anode has a surface area that corresponds to between about 60 and 95 percent of the platable surface area of the work piece to be plated. Preferably the work surface of the one or more secondary anodes has a surface area that corresponds to between about 5 and 40 percent of the platable surface area of the wafer to be plated.

In this example, anodes 725 and 727 are positioned in the bottom of vessel 713 such that there is sufficient space for vertical focusing element wall(s) 729 and an anode chamber wall 731. Focusing elements are effective in aiding methods of shaping current density in the electrolyte. The "virtual anodes" created by such focusing elements are "virtual" current sources, in this case at the element opening, which are mathematically and physically similar to the situation of having an actual anode located at the virtual anode locations. Therefore, one can obtain the benefits of having an anode at a particular location, without having to actually position the anode there.

Focusing elements of the invention preferably are made from, at least in part, an insulating material that is chemically compatible with the electrolyte. For example they can be made wholly of such material or be made of a non-insulative material that is coated with an insulative material. Suitable insulating materials for the focusing elements include at least one of plastic, nanoporous ceramic, and glass.

Anode chamber wall 729 defines a partially closed region for at least some of the focusing elements of anode segments in the anode assembly. A focusing element for the primary asymmetric anode 725 is used to focus current in electrolyte 715 arising from closure of the cell circuit between the cathode (seed layer 719) and primary asymmetric anode 725 (region A' in the electrolyte). Region A' is an asymmetric space spanning the distance between the work surface of anode 725 and seed layer 719 (see FIG. 3 for reference). Region B' is a similar asymmetric space associated with secondary anode 727.

Wafer holder 723 is capable of positioning wafer 721 in close proximity to the topmost portion of the focusing elements. Preferably the distance between the topmost portion of the focusing elements and the wafer is between about 0.5 and 20 millimeters during plating, more preferably about 2 to 5 millimeter. Preferably the walls of at least the anode chamber are between about 0.1 and 5 millimeters thick, more preferably between about 0.25 and 1 millimeters thick. Similar thickness ranges are appropriate for all the focusing element walls in the reactor.

Preferably the work surface areas of the virtual anodes of the invention are aligned to the work surface of the seed layer on which metal is deposited to thereby provide a relatively direct current path between the anode and the work piece. In practice this means that the rotational axes or center points of the anode and work piece should be substantially aligned and the planes defined by these electrodes should be substantially parallel. Further, the outer perimeters and areas of these electrodes (possibly as traced during a single rotation) should be substantially similar. FIG. 4 provides an example of such arrangement.

Plating cells of the invention can include a variety other features not shown in FIG. 7. The particular application and apparatus context will dictate the use of such other features. As examples, the apparatus may include flow flutes configured to distribute the electrolyte flow between the area encompassed by a focusing element for the primary asymmetric anode, and areas encompassed by focusing elements for one or more other asymmetric anodes. In some plating cells, diffuser membranes are used to create a uniform flow front in the electrolyte that impinges, for example, on the work surface of a wafer. In other embodiments, the apparatus includes a shielding element configured to shield a circumferential edge portion of the wafer from plating current during electroplating. Such shielding elements include, for example, a perforated ring shield proximate to the topmost portion of the anode chamber wall and/or a shielding element associated with the wafer holder.

For a number of practical reasons as described in-provisional U.S. patent application Ser. No. 9/392,203, filed Jun. 28, 2002 (Liquid Treatnent Using Thin Liquid Layer microcell), it may be desirable to perform electroplating operations in a thin liquid layer, face up or down configuration, referred to internally as a "microcell" or "microgap" configuration.

The anodes used with this invention can be of either an inert or consumable type. The reactions of the consumable type (also referred to as active anodes) for plating Copper ions are simple and balanced (no overall depletion or generation of new species). Copper ions in solution and reduced at the cathode and removed from the electrolyte, simultaneously as copper is oxidized at the anode and copper ions added to the electrolyte. The inert type (also referred to as "dimensionally stable" and non-reactive) provides unbalanced reactions and copper ions (or ions of any other metal being plated) must be added to plating solution.

Conclusion

Although various details have been omitted for clarity's sake, various design alternatives may be implemented. Therefore the present examples are to be considered as illustrative and not restrictive, and the invention is not to be limited to the details given herein but may be modified within the scope of the appended claims.

What is claimed is:

1. A method of electroplating a substantially uniform layer of a metal onto a conductive seed layer of a work piece, the method comprising:

(a) providing an azimuthally asymmetric anode in a reactor;

(b) providing the work piece in the reactor at a position substantially aligned with the azimuthally asymmetric anode;

(c) rotating the work piece with respect to the azimuthally asymmetric anode while contacting a plating solution containing ions of the metal; and (d) plating metal onto the work piece while rotating to thereby provide a radially varying source of current over the period of rotation.

2. The method of claim 1, wherein the anode has an azimuthally varying radius.

3. The method of claim 2, wherein the anode radius varies gradually in the azimuthal direction.

4. The method of claim 1, wherein the anode occupies an angular arc that is generally greater in a center region of the anode, as determined with respect to the substantially aligned work piece, than in an edge region of the electrode.

5. The method of claim 1, wherein rotating the work piece with respect to the azimuthally asymmetric anode increases the current at or near the center of rotation in relation to the current at the anode periphery.

6. The method of claim 1, wherein the work piece is a semiconductor wafer and the seed layer covers the front side work surface of the wafer.

7. The method of claim 1, wherein (d) comprises immersing at least that portion of the work piece having the seed layer thereon in the plating solution.

8. The method of claim 1, wherein (d) comprises passing a current between the seed layer and the azimuthally asymmetric anode whereby the current is distributed such that, over a period of rotation during plating, the metal is deposited substantially uniformly onto the entire surface area of the seed layer.

9. The method of claim 1, further comprising providing one or more anode segments, each isolated from each other and from the azimuthally asymmetric anode so that they can deliver plating current independently of one another.

10. The method of claim 9, further comprising delivering current from an anode segment only after the plating in (d) has taken place for a period of time.

11. The method of claim 10, wherein delivering current from the anode segment comprises delivering pulses of current from the anode segment.

12. The method of claim 11, wherein a duty cycle of the current pulses increases over time such that a percentage of the total current attributable to the anode segment increases over time.

13. The method of claim 10, wherein (d) comprises distributing the current between the azimuthally asymmetric anode and at least one other anode segment arranged to reduce, over time, non-uniformity in current delivered to the work piece.

14. An apparatus for electroplating a substantially uniform layer of a metal onto a conductive seed layer of a work piece, the apparatus comprising:

(a) a reactor chamber;

(b) an azimuthally asymmetric anode in the reactor chamber;

(c) a work piece holder for holding the work piece in the reactor at a position substantially in alignment with the azimuthally asymmetric anode; and (d) a mechanism for rotating at least one of the work piece and the azimuthally asymmetric anode with respect to the other.

15. The apparatus of claim 14, wherein the anode has an azimuthally varying radius.

16. The apparatus of claim 15, wherein the anode radius varies gradually in the azimuthal direction.

17. The method of claim 14, wherein the anode occupies an angular arc that is generally greater in a center region of the anode, as determined with respect to the substantially aligned work piece, than in an edge region of the electrode.

18. The apparatus of claim 14, further comprising one or more anode segments, each isolated from each other and from the azimuthally asymmetric anode so that they can deliver plating current independently of one another.

19. The apparatus of claim 18, further comprising a control circuit for independently adjusting the current delivered from the azimuthally asymmetric anode and each of the one or more anode segments.

20. The apparatus of claim 19, wherein the control circuit is designed or configured to deliver current from an anode segment only after first delivering current from the azimuthally asymmetric anode for a period of time.

21. The apparatus of claim 19, wherein there are two or more anode segments.

22. The apparatus of claim 19, wherein the control circuit is designed or configured to deliver current pulses from the anode segment.

23. The apparatus of claim 22, wherein the control circuit is designed or configured to adjust a duty cycle of the current pulses over time such that a percentage of the total current attributable to the anode segment increases over time.

24. The apparatus of claim 14, wherein the work piece holder is designed to position the wafer in a plating bath of the plating cell.

25. The apparatus of claim 14, further comprising an insulating focusing wall around the azimuthally asymmetric anode to focus current from said asymmetric anode in an electrolyte provided between the work piece and said asymmetric anode during electroplating.

26. The apparatus of claim 25, further comprising:

an anode segment isolated from the azimuthally asymmetric anode so that the anode segment and the asymmetric anode can deliver plating current independently of one another; and an insulating focusing wall around the anode segment to focus current from the anode segment in the electrolyte.

* * * * *